US007166045B1

(12) United States Patent
Linner et al.

(10) Patent No.: US 7,166,045 B1
(45) Date of Patent: Jan. 23, 2007

(54) INSTALLATION FOR A COMPETITIVE GAME WITH HOCKEY STICK AND HOCKEY PUCK

(75) Inventors: Rudolf Linner, Seeon (DE); Hans Linner, Seeon (DE)

(73) Assignee: RapidShot North America Inc.,, Chardon, OH (US)

( * ) Notice: Subject to any disclaimer, the term of this patent is extended or adjusted under 35 U.S.C. 154(b) by 299 days.

(21) Appl. No.: 10/018,620

(22) PCT Filed: May 30, 2000

(86) PCT No.: PCT/DE00/01800

§ 371 (c)(1),
(2), (4) Date: Apr. 12, 2002

(87) PCT Pub. No.: WO00/78414

PCT Pub. Date: Dec. 28, 2000

(30) Foreign Application Priority Data

Jun. 17, 1999 (DE) ..... 199 27 609

(51) Int. Cl.
*A63B 69/00* (2006.01)

(52) U.S. Cl. ..... 473/446; 446/422; 446/431

(58) Field of Classification Search ..... 473/446, 473/471, 478, 431, 426, 451, 415, 470, 472, 473/247; 273/440, 444, 447; 434/247; 463/30, 463/1, 40–42
See application file for complete search history.

(56) References Cited

U.S. PATENT DOCUMENTS 3,765,675 A * 10/1973 DiMarzio ..... 473/446
4,607,842 A 8/1986 Daoust
5,396,876 A * 3/1995 Liscio et al. ..... 124/6
5,465,958 A * 11/1995 Brun ..... 473/426
5,498,000 A * 3/1996 Cuneo ..... 473/471
5,509,650 A 4/1996 MacDonald
5,509,652 A * 4/1996 Woronets ..... 473/446
5,707,304 A * 1/1998 BelleIsle ..... 473/431
5,748,073 A * 5/1998 Crawford ..... 340/323 R
5,776,019 A * 7/1998 Kronenberger ..... 473/446
5,855,516 A * 1/1999 Eiba ..... 463/42
6,048,271 A * 4/2000 Barcelou ..... 463/48
6,174,237 B1 * 1/2001 Stephenson ..... 463/42

FOREIGN PATENT DOCUMENTS

WO WO 9524950 A * 8/1995
WO WO 9524950 A * 9/1995

* cited by examiner

*Primary Examiner*—Xuan M. Thai
*Assistant Examiner*—Alex F. R. P. Rada, II
(74) *Attorney, Agent, or Firm*—Akerman Senterfitt; Stephen A. Pendorf

(57) ABSTRACT

Disclosed is an installation for competitive play with an ice hockey stick and an ice hockey puck. The installation includes a game platform, a goal with targets, target identifiers and a computer. A computer controlled puck circuit includes a puck magazine (30), a passing unit (46) which feeds pucks (1) to a player (40), a conveyor apparatus (2) which sorts and conveys shot pucks (1) into the puck magazine (30). The points value of shots made by the player (40) are evaluated with the help of a light barrier A (48) and a light barrier B (49), a camera (50) und a corresponding underlying computer program and the points assigned form the basis for a competitive play which can be played over the international data network.

24 Claims, 7 Drawing Sheets

INSTALLATION FOR A COMPETITIVE GAME WITH HOCKEY STICK AND HOCKEY PUCK

BACKGROUND OF THE INVENTION

1. Field of the Invention

The invention relates to a device for the competitive game.

2. Description of the Related Art

Different devices are disclosed in different patents for goal shot training in ice hockey. Doust in U.S. Pat. No. 4,607,842 of Aug. 26, 1986 describes an installation wherein a player is provided with pucks from a puck container which are then shot towards an indicated target within an ice hockey goal. However, that invention has the following disadvantages: the player is not passed the pucks but, the pucks are conveyed in certain intervals onto the shooting surface; furthermore, the player must collect the shot pucks by hand and again fill them into the puck container; finally, no continuous analysis of the performance of the player is provided. This type of playing is very laborious and not very effective because of the numerous interruptions. That invention is not intended as a game device which in itself develops motivation for the player and would in no way be suited therefor.

In the U.S. Pat. No. 5,509,652 of Apr. 23, 1996 by Woronets, a training range for ice hockey is described which includes a platform from which one end players can shoot onto an ice hockey goal at the other end. However, any indication of a target is missing and no analysis takes place whether the goal has been hit. This device is intended to simulate a stadium atmosphere, whereby players can train stick handling skills, however in completely unstructured form.

Finally, U.S. Pat. No. 5,509,650 of Apr. 23, 1996 by MacDonald describes a training device which is positioned onto an ice surface and essentially is intended to replace a goalie in an ice hockey goal whereby targets are indicated and hits are registered and statistically analysed. However, that invention has inherent significant disadvantages, one single player in training requires ½ of the ice arena for himself, which in any case means that this training can only be done by privileged players; here again the player does not get the puck passed and he must collect each shot puck by hand. It is therefore a shortcoming that although the indicated targets are analysed, the individual targets are not meaningfully positioned and analysed; the target openings are so small that hits are very difficult and rather even accidental. A close approach to a target is valued as 0 just the same as a complete miss, which is no way close to reality. The repetition rate is very low, since the player each time must drive anew into the space captured by the cameras before he can shoot on the goal. In addition, this device does not offer standardized conditions, so that the results of different players are not comparable.

SUMMARY OF THE INVENTION

It is an object of the present invention to provide a game installation and at the same time a training installation for improvement of the shooting technique of ice hockey or roller hockey players under conditions close to reality, whereby by the closing of a puck circuit, a practically unlimited repetition rate is possible with an adjustable passing interwall for the analysis of the goal shot with the help of an intelligent computer dialog; the applicable game rules are to provide a new highly motivating competitive sport, wherein each participant can enter into a performance comparison which each other participant at any location in the world through the international data network.

Accordingly, the training or game unit is initialized, in that the player carries out different adjustments with respect to passing speed and passing interval, or in that he accepts the standard adjustments. He therefore uses a control console which represents a simplified computer keyboard with corresponding connection to the computer. It is constructed and positioned so that the player can carry out all commands to the program with a hockey stick in hand. For this purpose, the control console is provided with correspondingly formed, large control keys. The control console is placed flat on the ground and is moveable so that left handed as well as right handed individuals can move it to their respectively opposite side and into the most comfortable position.

About 60–70 pucks are stored in a puck magazine. Since preferably as many pucks as possible are to be stored on a surface as small as possible and in a short as possible distance to the passing unit, the magazine is constructed as an upstanding type in which the pucks lie one after the other on a helical ramp and are forced downwardly by gravity. The puck magazine does not include any mechanical parts and can therefore be manufactured very easily and cost effectively. Some height above the platform plane, the downwardly inclined puck channel is located in passing direction. A separating roller of a puck dispenser engages into this puck channel and with stands the pressure of the pucks in the magazine. When the player now pushes the input key, the main procedure of the computer program is started. The rotatable disk of the puck dispenser rotates until the first puck is liberated and the second puck is blocked by the next separating roller. The first puck slides in the downwardly inclined puck channel with the corresponding initial speed between two oppositely rotating accelerator rollers of the passing unit, whereby the speed of the accelerator rollers was previously adjusted by the player or the standard adjustment was accepted. The rollers engage the puck and accelerate it so that it is played as a pass in direction of the player.

The puck thereby passes two light barriers; upon passing of the light barrier closer to the player, the signal generated initiates the program to generate a random number. According to this random number, one of the four corners of the goal frame is indicated as target corner in that an associated lamp is illuminated. At the point in time of triggering the light barrier, the measurement of the reaction time begins. The player accepts the pass and tries to shoot the puck into the indicated target corner as quickly as possible, but at the same time as precisely as possible. The shot puck again passes the closer light barrier and thereby initiates the starting point of the speed measurement and at the same time the end point of the reaction time measurement. The reaction time thereby indicates how long the player takes before getting the pass under control and again playing it or shooting it.

The puck passes the light barrier located further away and thereby initiates the end point of the speed measurement, whereby the time measurement is carried out by way of the high resolution time of the computer (performance counter frequency), the resolution in the microsecond range; this enables a reliable speed calculation in the range of a hundreth of a km/h. On the basis of the measured speed, the point in time for reaching the goal line is calculated. At that calculated point in time, a camera connected to the parallel port of the computer (standard camera or video transmission on the data network, for example, Webcam II of the company Creative) is activated. This camera is positioned in the back of the player slightly above the platform and over the center line of the platform and is aimed at the goal frame.

The open surface of the goal has four target corners in the four corners of the goal frame. Each target corner is preferably divided into three hierarchically organized partial target surfaces, which have a characteristic color, for example "blue target" according to their values. The smallest and thereby most difficult to hit partial goal surface and thereby the riskiest to aim at results in the highest number of points and so on. When the puck now reaches the goal line, the camera deposits a bitmap in the main memory of the computer. The program compares the temporary bitmap with a stored bitmap which represents the same image but without puck. Depending on which target corner was indicated as target, the associated sections of the bitmap are now compared with one another. The brightness values of the three partial target regions are compared bit by bit. A brightness difference in a partial target region represents a hit for this partial target. If no difference is recognized, the shot is registered as a miss. The base number of points for the hit target is calculated together with the determined reaction time, the shots as well as the factors for passing speed and passing interval into a total number of points, which are immediately displayed together with the individual data of the shot on a monitor which is mounted height adjustable and is therefore easily adjustable by the player.

A moveably suspended target mat fills the goalframe; when the puck impacts hereon, the energy is absorbed by the yielding target mat to such a degree that the puck essentially drops down. If the puck misses the goal, it impacts on a range enclosure in the form of a heavy tarpaulin which is suspended from above and also makes the puck drop. Below the goal frame, two mutually approaching collector surfaces form a channel which is dimensioned so that the pucks dropping from the target mat as well as from the range enclosure impact on the collector surfaces and slide or roll into a conveying channel. A special conveyor chain in ladder shape runs in this conveying channel, whereby special transverse "rungs" are connected at both ends with a toothed belt or other suitable flat belts "transients".

The whole conveying apparatus has the purpose to order the pucks which reach the conveying channel in all different orientations in such a way that each puck is deposited flat and centrally located in a row in the magazine. However, the conveyor apparatus must also be able to handle a sudden flood of pucks and to unravel a group without jamming up the pucks. Different constructive measures have been taken for this object: First, the walls of the conveying channel are perpendicular and higher than the diameter of one puck; it is ensured thereby that a puck is not only located half but wholly in the conveying channel and thereby captured by one of the drivers.

Second, the conveying channel is more narrow than two side by side pucks; it is ensured therewith that the pucks have a tendency to align one behind another. Third, the drivers on the conveying side have a recess with a radius equal to the radius of a puck; it is achieved thereby that a puck which lies flat in front of the driver is automatically centered as soon as it is pushed and that it does not leave this position until the end of the conveyor path. Fourth, the conveying channel in conveying direction becomes generally wider; this ensures that a group of pucks cannot jam. Fifth, the conveying channel is upwardly inclined in a terminal section at an end of 45°; it is achieved thereby that pucks transported in that section in an upright orientation again and again roll backwards over the drivers and over pucks positioned flat until they finally come to lie flat in front of a driver and are then transported through. Sixth, knock-down members are provided at the perpendicular portion of the conveyor between which a puck centered on a driver is conveyed undisturbed; it is achieved therewith that pucks which lie flat but are not centered are knocked off and fall back onto the horizontal portion of the conveyor until they first come to lie flat and are centered in front of a driver. Thus, correctly positioned, centered pucks are exclusively found in the upper portion of the conveyor.

At the upper return point of the conveyor chain a takeoff tongue engages a cutout in the driver. If a puck is positioned at the driver, the puck is pushed by the driver onto this takeoff tongue to run on a downwardly inclined track into the helical track of the magazine so that the pucks are available in a long row in order to be again played to the player. In this manner, the player has received 16 passes (or any other preselected number) upon completion of a series.

Each score is immediately displayed as a bargraph on the monitor, with the bar being the higher the more points. Additionally, the color of the bar assumes the color of the score category; the player can thereby with one look capture the standings of his actual series even at a quick pass succession. At the same time, the points achieved are acoustically indicated in that for each score the score category is indicated at a specific pitch and the length of the tone corresponds to the number of points. At the end of the series, the player can study the data of the individual shots in detail, he can switch by way of the control console to a detailed statistical analysis and then return to a new series, he can request from the system an analysis of his previous results which gives indications of weaknesses and strengths and tips for special training forms, or he can terminate the game.

The training idea behind this installation is based on the following principle thoughts. In each team sport with goals, the capability of above all the forward to use goal chances in the best way is critical. This capability is a combination of more basic capabilities, which in the case of ice hockey are: puck control in general, control upon acceptance of the puck, which means the puck must be located from where it can immediately be passed on or shot onto the goal; assessment of the situation in front of the goal, any and which regions of the goal at any moment are covered so little that a goal shot promises to be successful; quick reaction in order to be able to quickly capitalize on such a situation; best possible shot technique for precision and hardness of the shot; enough muscle strength and concentration to be able to launch a good goal shot at any time; mental strength in order to be able to play all essential properties even under pressure.

The acceptable suitability of the described installation for goal shot training is based first of all on the high repetition rate which is enabled by the closed puck circuit. A time consuming picking up and sorting of the pucks which interferes with the training flow is completely obviated. In addition, the player within the puck circuit not only gets provided with pucks, but they are as realistically as possible respectively played to him as passes. Thus, he simultaneously trains a clean pass acceptance which is the prerequisite for a quick and good shot.

These technical possibilities together with a computer program developed for this installation form the prerequisite for an instantaneous reporting on the quality of each individual shot back to the player. All factors important for the assessment of a shot are thereby weighted close to reality.

Precision is foremost. Only the hit of an indicated target counts and establishes a point value dependent on the partial target surface (category) hit. The partial target surfaces are differentiated by color; the color of the partial target hit is displayed on the monitor for each hit. Second of all is the reaction time, actually the preparation time, which a player needs for converting a received pass into a goal shot. The faster a player recognizes a target (registration of the illumination of a target lamp as target indicator, the faster he has the puck in the best possible position for a shot and the faster he releases, the higher is the reaction time factor with which the point value is multiplied and correspondingly the larger would be the chance to achieve a goal in a real-life game. At the third position is the pure speed of the shot. The harder the shot the more difficult it is for the goalie to block the shot. The respective speed results also in a factor with which the point value of hit precision and reaction time is multiplied.

Finally, the player can influence the point value with two adjustable factors: if he chooses a higher pass speed, the requirements for a clean reception of the pass are increased and the point value of a hit is correspondingly multiplied with a higher factor. One proceeds similarly with the pass interval, since a fast pass succession places higher requirements on the stick handling, reaction and concentration.

The precision of the shot is immediately graphically displayed and also acoustically signalled. A direct feedback is thereby produced which automatically guides the player to a constant readjustment and to a systematic approach to the best possible shot. A statistical analysis is always available for an overall training control, in which, for example, the performance curves for shot precision, reaction time and shot speed are illustrated.

The high repetition rate (about 700 shots per 30 minutes) and a direct feedback are the best preconditions for an automation of the whole level of movement with regard to an automated goal shot having a very much higher hit probability. Regarding the pure shot technique, the movements become more economic, precise and relaxed and the timing and direction of the goal shot is mentally no longer delayed or even blocked by thinking and decision making and possibly by nervousness (one can think of the automation of the stroke variants in tennis). For a highly automated, which means in the preparation time extremely shortened goal shot, the anticipation of the shot direction is made more difficult for the opposing goalie in a real game on the field and the hit probability is thereby increased. Automation of the goal shot would translate for each ice hockey player into a significant increase in effectiveness and reliability. It is one of the immediate goals of the described installation to fulfill exactly this object.

It is a further advantage of this installation that the required special muscles are optimally trained by the described repetition rate. A player can also improve his stress resistance in that he adjusts a shorter pass interval and thereby systematically exposes himself to higher pressure, analog to the pressure in front of the goal of the opposing team in a real game. Concentration and mental stress are also components of the statistical analysis which each player can recall at any time.

Since existing weaknesses of a player are unconditionally uncovered, it is useful to support the player in overcoming those weaknesses. The program therefore analyses the weaknesses and offers suggestions for special training forms. For example, if it is discovered that a player has a significantly lower hit rate with higher targets than with lower targets, hints for an improvement of the shot technique for higher shots are output upon a corresponding request by the player to the program and a special training program is suggested in which only the upper corners are given as targets.

The described installation is an ideal training installation also with respect to a last decisive aspect: the motivation for training comes from the training itself since training is play and play is training. Since the rules of play apply for the use as training installation as well as for the use as a game installation, this training does not mean torment but is a game corresponding to the game instinct and the sporting ambition of each and every ice hockey player all the way to the professional level.

The game idea for the described installation resides in that it is a competitive game with thought out rules in which each interested party can participate without a limit to the number of participants or the performance standard and that the results achieved from all players are compared with one another in a worldwide ranking list. The smallest unit of play is the series which preferably consists of 16 shots. The average values are formed from the 16 shots which are referred to as a series result. The three best series results of a day form an average daily result. This is very significant for the attitude of a player because this means with each started series a good chance exists to improve the preliminary daily result since only the number of points of the third best series result must be exceeded. If a player in the three best series results has, for example, 260 points, 283 points and 300 points, i.e. 281 points as a daily result, he need only surpass the 260 points of his third best series result for an improvement of his daily result. If he achieves 266 points with that series, for example, his daily result improves to 283 points. Conversely, his daily result can never worsen, since always only the three best series results are counted. He can therefore light heartedly try further series and experiment with different program adjustments and shot techniques, always with the chance for improvement. The three best series results are always displayed on the monitor as a goal and the approachment thereto during a current series is graphically and acoustically illustrated, which is extremely motivating and also always includes an element of sensation.

The average of the three best daily results in turn forms the results for the worldwide ranking list according to the same principle of the stable approach. It also applies here that the result for the worldwide ranking list is improved upon surpassing of the so far third best daily result. The three best daily results are also displayed during a current series and an approach for improvement is correspondingly signalled. A weak daily result here again is of no harm. The rankings result is furthermore automatically refreshed, in that daily results more than a year old are removed from the calculation. No longer active players gradually fall from the ranking list and players which do not make any progress for over a year thereby slide lower. Apart from the absolute ranking list, it is useful to keep a percentage ranking list which maintains a stable size, irrespective of how many new participants are added. It is better and simpler to know about a player that he belongs to the best 52%, for example, than that he is momentarily at position 1,250, but possibly after a short time, because of many new added participants, is at position 1,400 with the same ranking list results, while the percentwise ranking listing position would change only little during a rather continuous growth in participants. It is also better when this player as immediate goal can formulate the ascent into the top 50%, instead of targeting a fixed absolute ranking list position.

The ranking list can be viewed absolutely or according to different viewing criteria which can be freely selected by the interested party. For example, one can view according to player age group, cities and regions, play category membership, and so on. During the viewing, the percentage mode which is more easy to view and more evident, can be used. However, it generally remains that each participant in the game can compare himself at any time with the absolute top, which may be well be the first time in the history of sports. The prerequisites are thereby created that at any location in the world, the described standardized arrangement can be installed, which objectively captures a defined sport performance and transmits the data through the datanet to a central data bank where they are sorted according to preset criteria. It has been especially considered during the conception that the play is equally gripping in the lowest as well as in the highest performance range. The partial target surfaces of lowest value are thereby so large that it is rather improbable that a player finishes a series without one point. It is to be avoided that a weakly shooting player is discouraged and does not reach the point at which he realizes that even he can significantly improve his result with hard work and skill, irrespective of his level. On the other hand, it is practically impossible for a very well shooting player to hit all targets of highest value within a series, especially under the pressure of a fast pass sequence.

It is a further attraction of this new competitive game to find a strategy for each individual player, since the total number of points for each hit is composed of so many variable factors. Each player must correctly estimate his weaknesses and strengths in order to achieve the best possible result. He must, for example, find out if it is better to attempt the a hardest possible shot and to accept a longer preparation time or if he maintains the preparation time as short a possible, and therefore must back off in the hardness of the shot. The player must also find out which pass speed and pass sequence he can still handle well enough so that the precision of the shots does not fall under his current level. The corresponding decisions to which a player is consequently guided in a given training condition consequently by the concept and the described analysis mode, should essentially also stand the test on the ice hockey field. An ice hockey player, thereby for the first time has the possibility to systematically analyse and improve his goal shot qualities and to translate them into action during the game.

BRIEF DESCRIPTION OF DRAWINGS

The invention is further described in more detail in the following with reference to drawings.

it shows.

DETAILED DISCLOSURE OF THE INVENTION

Figure 1:
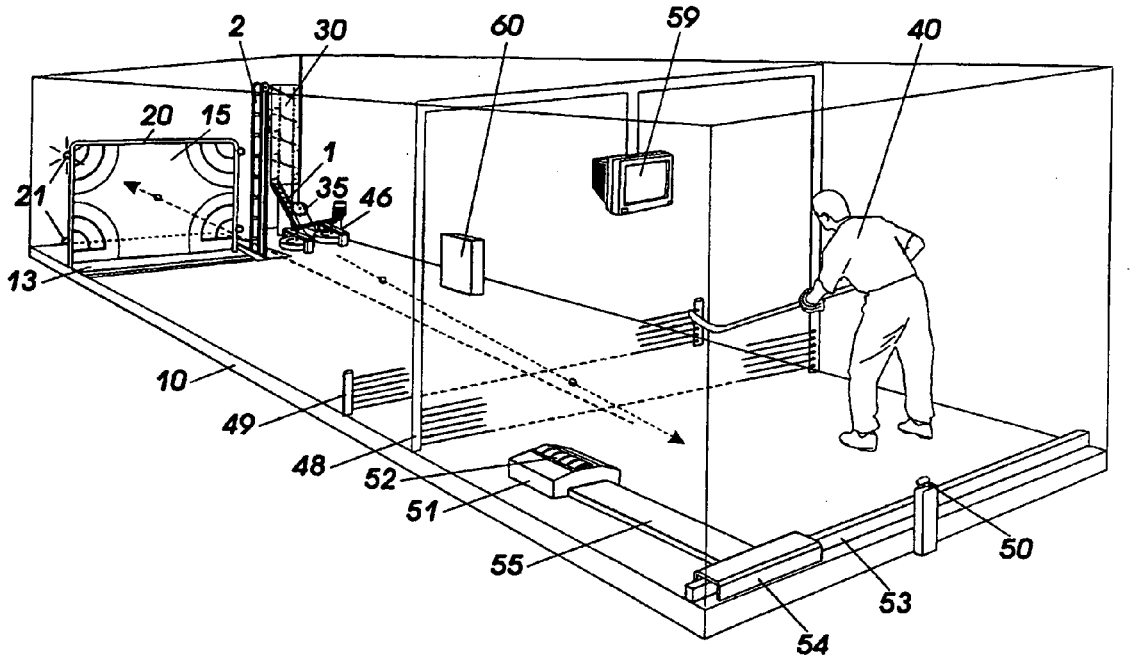
FIG. 1 a perspective overall view of the installation.

The overall view of the installation illustrated in FIG. 1 shows a player 40 which can make an input to a computer 60 by way of control keys 52 of a control console 51. The control console 51 is connected by a connecting arm 55 with a carrier sled 54 which can be moved on a carrier track 53.

Pucks are stored in a puck magazine 30. A puck dispenser 35 lets a puck 1 slide by way of gravity into a passing unit 46 which passes the puck to the player 40. On its way, the puck 1 passes a light barrier-B 49 and a light barrier-A 48, whereby upon passing of the light barrier-A 48, a signal is sent to the computer 60. This signal causes a computer program to select a target which is indicated by illumination of one of the four target lamps 21. At the same time, with the passing of the light barrier-A 48, the starting point for the measurement of the reaction time is set in the computer program. When the puck 1 is shot towards a target mat 15 which is suspended in a goal frame 20, the puck 1 again passes the light barrier-A 48 whereby the end point is set for the reaction time and at the same time the starting point for the speed measurement is set. When the puck 1 passes the light barrier-B 49, the end point for the speed measurement is set. The computer program calculates the speed of the puck 1 and derives therefrom the point in time of impact of the puck 1 on the target mat 15. Exactly at this calculated point in time the camera 50 is activated which is arrived at the target mat 15. The puck 1 drops down from the target mat 15 and falls onto the inclined collector surface 13, from which it reaches the conveying channel 14 (FIG. 3) and is conveyed by a conveying apparatus 2 again into the puck magazine 30. A monitor 59 is mounted for adjustment in height and is therefore well visible for the player 40.

Figure 2:
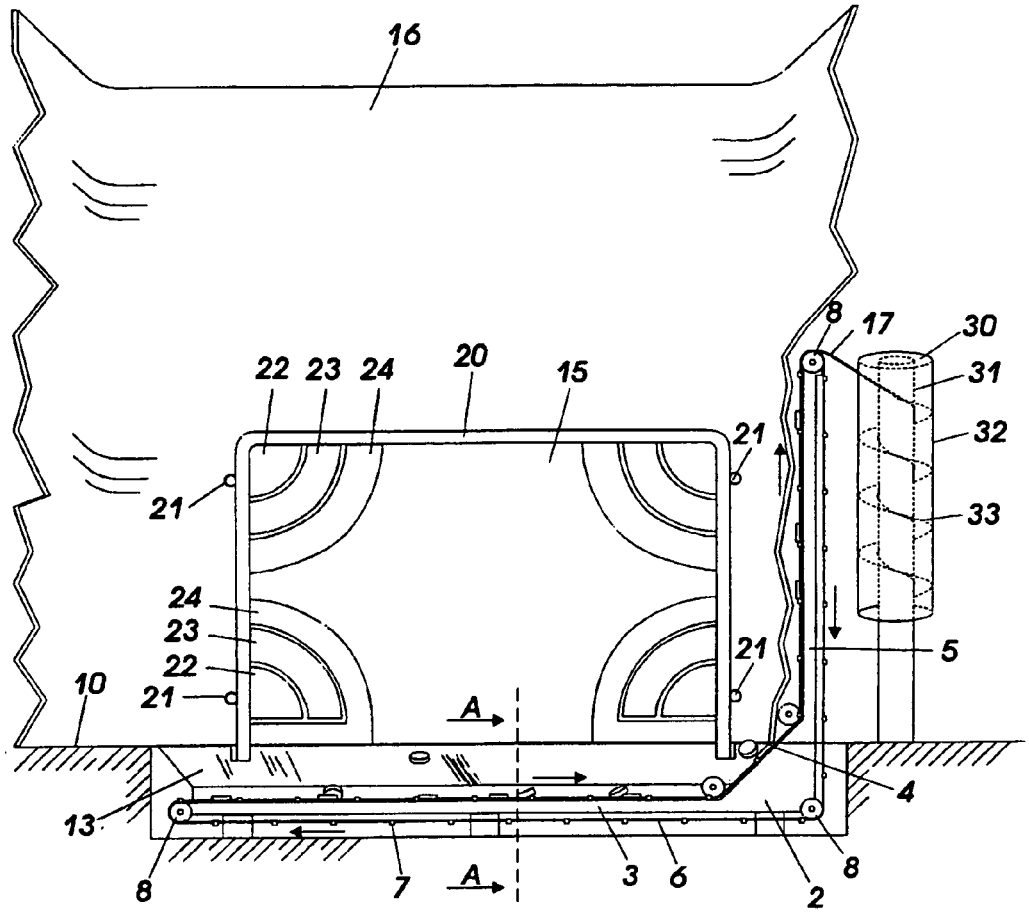
FIG. 2 a front view of the goal with conveying apparatus and magazine from the perspective of the player.

FIG. 2 shows a goal frame 20 with the target mat 15 suspended therefrom and the partial target surfaces-A 22, partial target surfaces-B 23 and partial target surfaces-C 24 applied on a target mat 15, as well as the target lamps 21 fastened to the goalframe 20. The conveying apparatus 2 essentially consists of a horizontal conveyor portion 3, an inclined conveyor portion 4 and a vertical conveyor portion 5. Conveyor belts 6 are guided along the conveyor portions 3, 4 and 5 with the help of conveyor belt rollers 8. A multitude of drivers 7 are mounted on the conveyor belts 6.

It is apparent how pucks 1 will roll or slide along the inclined collector surface 13 onto the horizontal conveyor track 3 and how they are there captured by drivers 7 and transported through the inclined conveyor portion 4 and the vertical conveyor portion 5 to a takeoff 17 and can slide from there onto a helical ramp 33 of the puck magazine 30. An inner tube 31 thereby forms the inner boundary of the helical ramp 33 and an outer tube 32 forms the outer boundary and thereby also the outer wall of the puck magazine 30.

An enclosure tarpaulin 16 is illustrated partially cut away in order to allow the view onto the vertical conveyor track 5 on the puck magazine 30. This enclosure tarpaulin 16 serves to catch those shots which missed the target mat 15 and to make them drop onto the inclined collector surface 13. It is pulled between the goal frame 20 and the conveyor apparatus 2 in order to protect the latter and the puck magazine 30 as well as other technical components illustrated in FIGS. 8–10.

Figure 3:
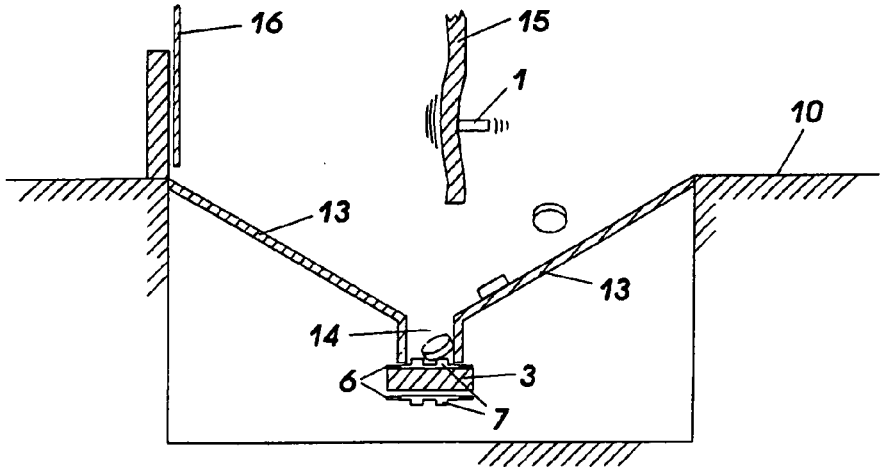
FIG. 3 a section A—A of FIG. 2.

The path of a puck 1 is shown in FIG. 3 as it initially impacts on the target mat 15, then drops onto the inclined collector surface 13, from there rolls or slides into a conveyor channel 14 and is captured by one of the drivers 7. The enclosure tarpaulin 16 ends closely above the game platform 10 in order to softly capture an impacting puck 1.

Figure 4:
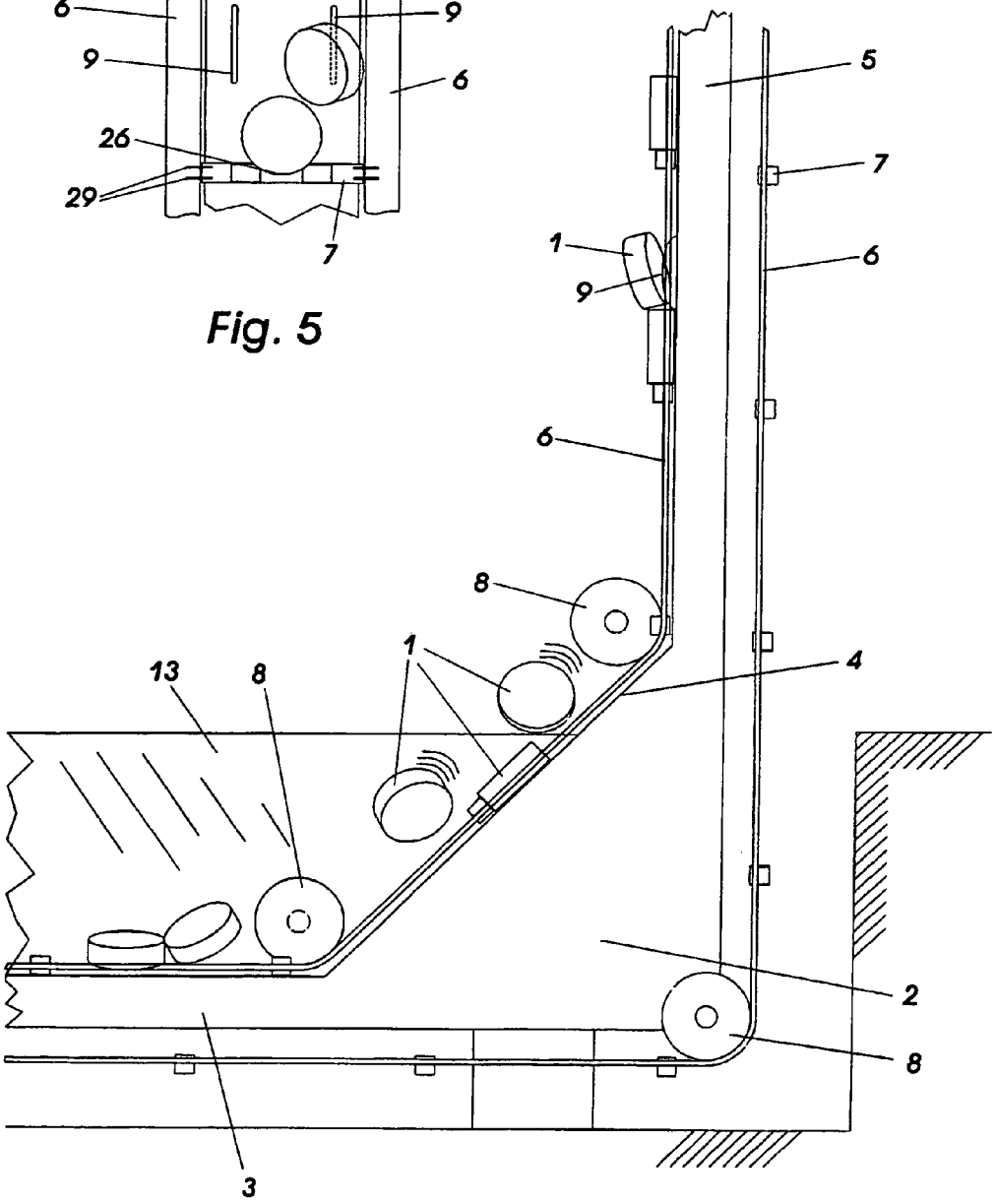
FIG. 4 a side view of a portion of the conveying apparatus.

FIG. 4 shows a portion of the conveyor apparatus 2. It is apparent how pucks 1 which lie unoriented on the horizontal conveyor track 3 are transported onto the inclined conveyor portion 4, where pucks 1 which up to that point are transported standing on the mantle surface or lying one above the other roll or slide back onto the horizontal conveyor path 3. At the latest upon the transition to the vertical conveyor portion 4, all pucks 1 not lying flat fall back. On the further path along the vertical conveyor portion, throwoffs 9 project from the vertical conveyor path 5, which knock off non-centered pucks 1 and throw them back into the horizontal conveyor path 3.

Figure 5:
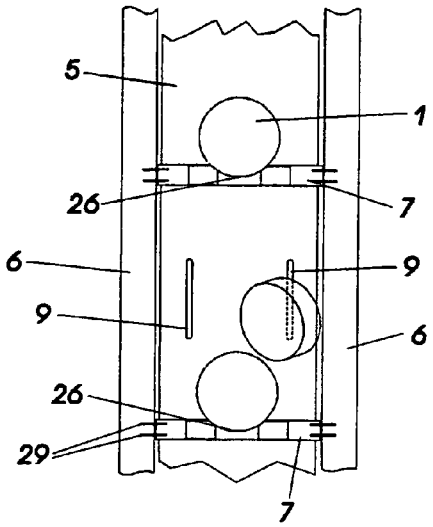
FIG. 5 a plan view of a portion of the vertical conveyor portion.

This is illustrated in FIG. 5 in the top view onto a portion of the vertical conveyor portion 5. Pucks 1 are positioned in a recess 26 of the drivers 7, which are connected by way of connecting pins 29 with the conveyor belt 6. Centrally positioned pucks 1 are conveyed through between the throwoffs 9.

Figure 6:
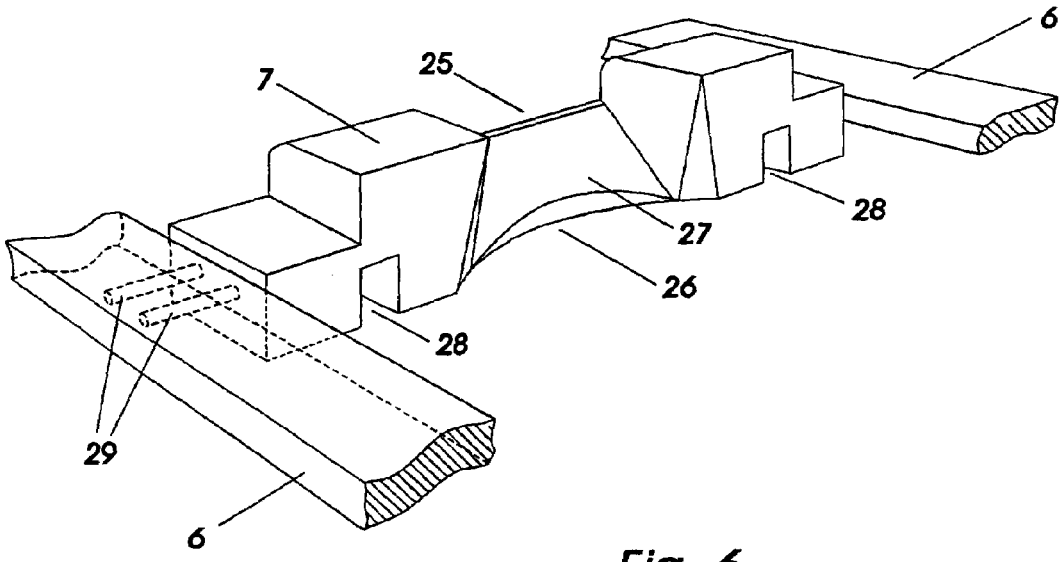
FIG. 6 a perspective detailed view of a driver.

FIG. 6 shows the special shaping of a driver 7. The recess 26 is necessary for the centering of a puck 1 in front of the driver 7. A liftoff tongue 18 (FIG. 7) reaches into a cutout 25 onto which the puck 1 is pushed for the transfer. During the transfer process, the liftoff tongue 18 slides onto a bevel 27. The driver 7 has grooves 28 for the free passage of the throwoffs 9 (FIG. 4, FIG. 5).

Figure 7:
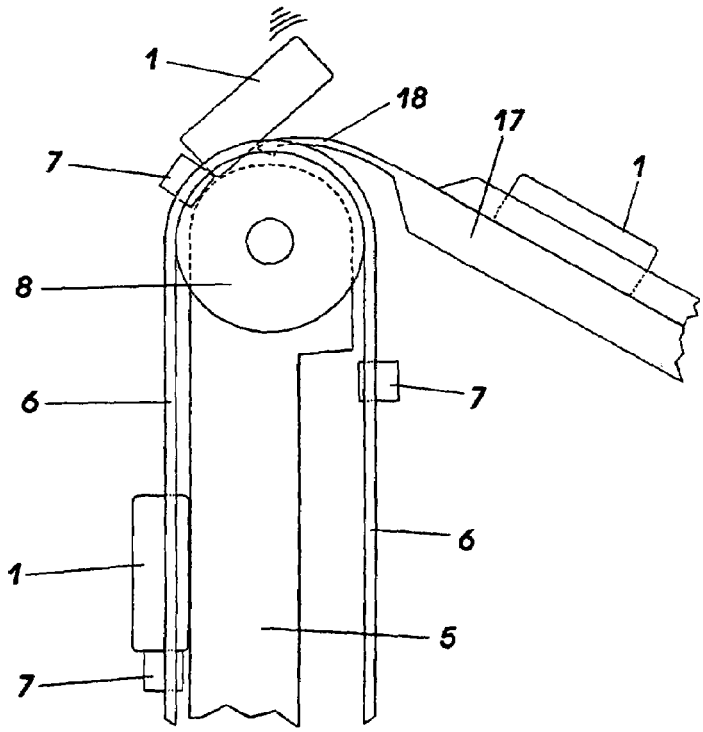
FIG. 7 a detailed view of the uppermost portion of the vertical conveyor portion.

FIG. 7 shows the upward end of the vertical conveyor portion 5 with the conveyor belt roller 8 around which the conveyor belts 6 with the drivers 7 are redirected downwardly in the transfer phase of the puck 1 of the takeoff 17. At the curved upper end of the vertical conveyor portion, the puck 1 is initially positioned upright on the driver 7, tips down as soon as the driver 7 follows the curvature and then rests against the takeoff tongue 18 which then slides onto the bevel 27. It is then further guided in the cutout 25 until the driver 7 later dives down. As long as the takeoff tongue 18 is guided in the cutout 25, the driver 7 further pushes the puck 1 onto the takeoff tongue 18 until the puck on the inclined takeoff 17 covers the further distance by way of gravity.

Figure 8:
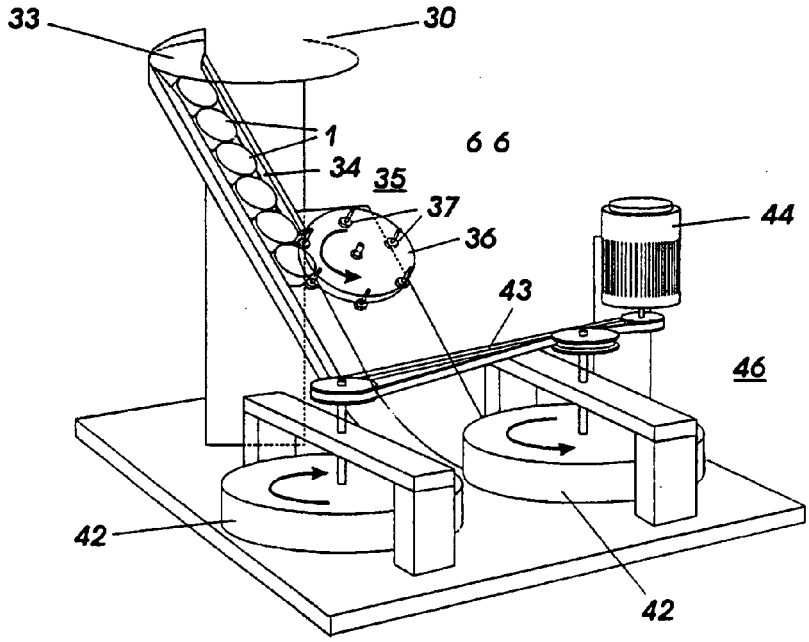
FIG. 8 a perspective view of the puck dispenser and passing unit.

FIG. 8 shows a series of pucks 1 on a puck channel 34 originating from the helical path 33 of the puck magazine 30. The first (lowermost) puck 1 in this row is held by a separating roller 37 engaging the puck channel 34. When the rotating disk 36 rotates by one step (60°), the first puck 1 is released, while the subsequent puck 1 is now held by a second separating roller 37 engaging the puck channel 34. The released puck now moves on the free part of the puck channel 34 into the passing unit 46. Two accelerator rollers 42 are there driven by a drive roller 44, in particular through a special control of a V-belt 43 in such a way that the accelerator rollers 42 rotate in opposite directions. The puck 1 is captured between the accelerator rollers 42 and accelerated.

Figure 9:
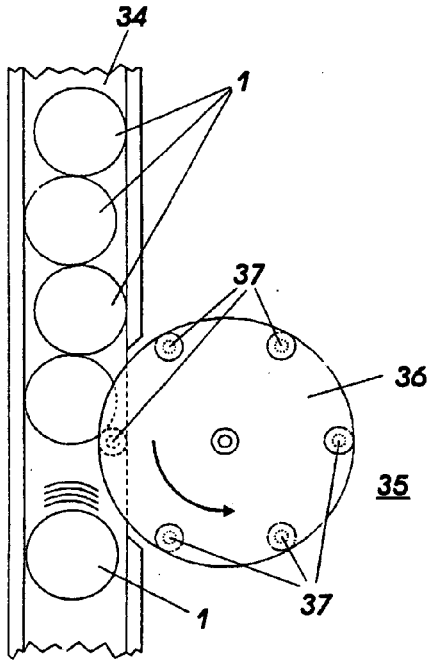
FIG. 9 a top view of the puck dispenser.

FIG. 9 illustrates how the first puck 1 was just released and how a separating roller 37 engages the puck channel and holds the second puck 1.

Figure 10:
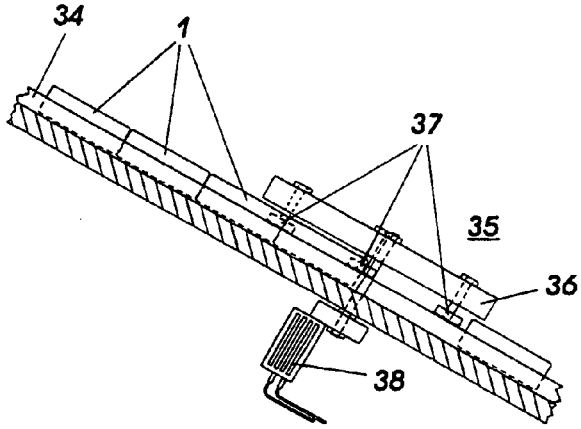
FIG. 10 a side view of the puck dispenser.

FIG. 10 shows the puck dispenser 35 and the puck channel 34 in the same phase but seen from the side, with a step motor 38 for control of the rotating disk 36.

Figure 11:
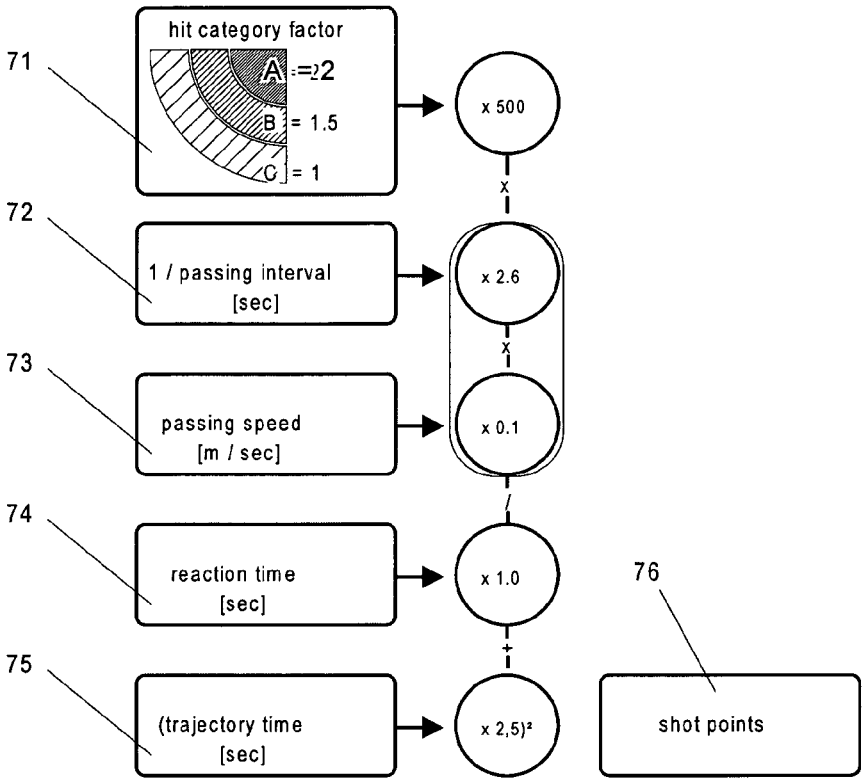
FIG. 11 is a flow chart of the point calculations.

FIG. 11 shows a flow chart of the point calculations, specifically showing that the calculation of the point value 76 is based on the factors hit category 71, passing interval 72, passing speed 73, reaction time 74 and trajectory time 75.

Figure 12:
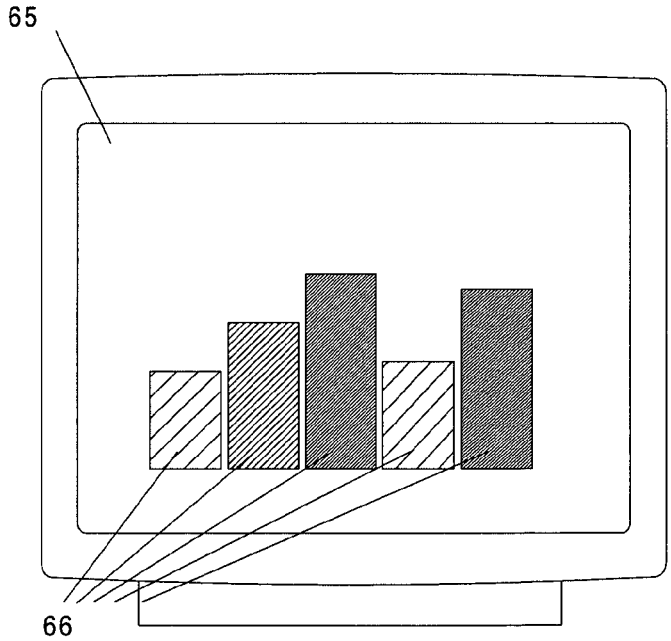
FIG. 12 is a perspective view of a graphic illustration of the point value for a shot on a monitor.

FIG. 12 shows the monitor 65 that displays a graphic illustration of the point value for a shot in the form of a bar 66. The in that the height of a bar corresponds to the number of points and the colour of the bar 66 corresponds to the target category hit.

Figure 13:
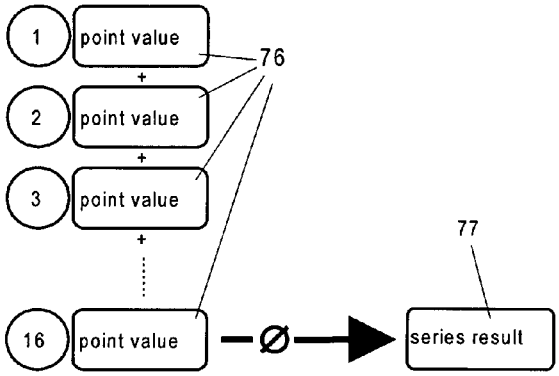
FIG. 13 is a flow chart for the calculation of a series result.

FIG. 13 shows a flow chart for the calculation of a series result 77 achieved on such a Device is carried out as the average shot point values 76 out of a selected number of shots, preferably 16 shots.

Figure 14:
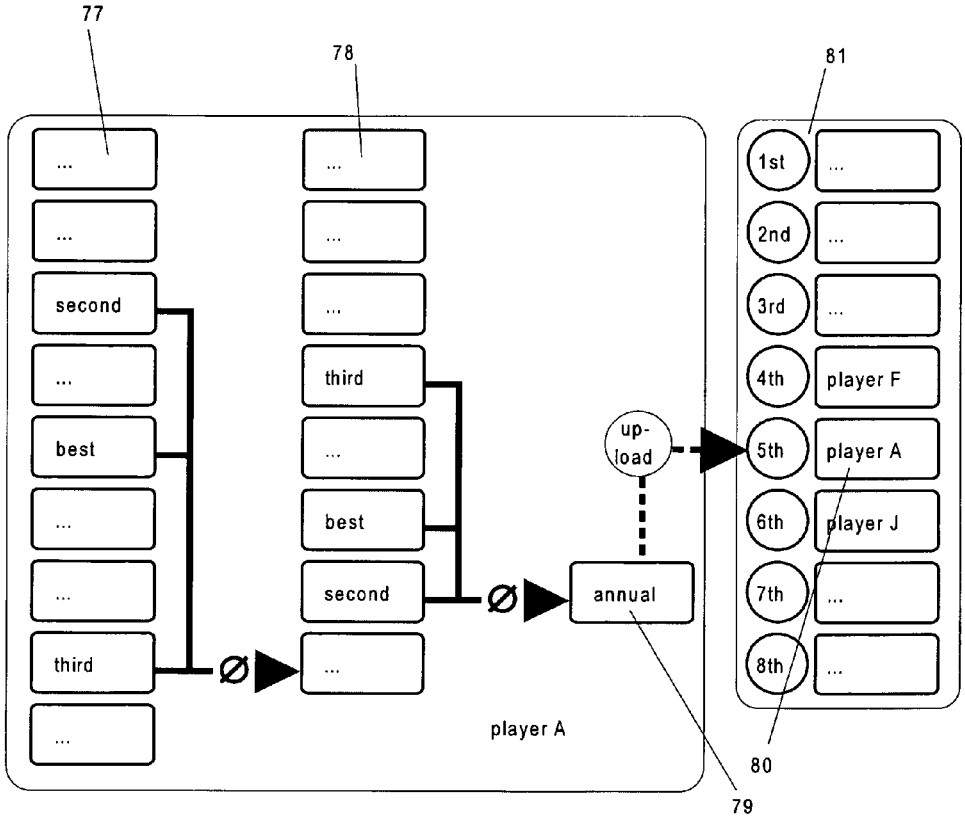
FIG. 14 is a flow chart for the calculation of a daily result.

FIG. 14 shows a flow chart for the calculation of daily result 78 achieved on such a Device is based on the average of at least two, preferably three best series results 77.

REFERENCE NUMBER LISTING

1 puck
2 conveying apparatus
3 horizontal conveyor portion
4 inclined conveyor portion
5 vertical conveyor portion
6 conveyor belt
7 driver 36 rotating disk
8 conveyor belt rollers
9 knock off member
10 game platform
13 inclined collector surface
14 conveying channel
15 target mat
16 enclosure tarpaulin
17 lift off
18 lift off tongue
20 goal frame
21 target lamp
22 partial target surface A
23 partial target surface B
24 partial target surface C
25 cut-out
26 recess
27 bevel
28 groove
29 connecting pin
30 puck magazine
31 inner tube
32 outer tube
33 helical ramp
34 puck channel
35 puck dispenser
37 separating rollers
38 step motor
40 player
42 accelerator roller
43 V-belt
44 drive motor
46 passing unit
48 light barrier A
49 light barrier B
50 camera
51 control console
52 control keys
53 carrier track
54 carrier sled
55 connecting arm
59 monitor
60 computer

What is claimed is:

1. A device for competitive play with hockey stick and hockey puck with a game platform, a goal with targets, target identifiers and a computer, the device comprising; a computer controlled puck circulation is closed with a puck magazine (30), a passing unit (46) which passes pucks (1) to a player (40), a conveyor apparatus (2) which sorts and conveys shot pucks (1) into a puck magazine (30), and wherein with the use of a light barrier A (48) and a light barrier B (49), a camera (50) and a computer program, shots made by the player (40) are evaluated and assigned a point value and the point value can be entered into an international data network to be party to competitive play; and the puck magazine (30) is made essentially of an outer tube (31) and an inner tube (32) and a helical ramp (33) between the outer tube (31) and the inner tube (32), whereby the helical ramp (33) is only wide enough that the pucks (1) must be aligned in a row behind one another and that the slope and surface of the helical ramp (33) are constructed such that the pucks advance automatically under the influence of gravity.

2. The device for competitive play with hockey stick and hockey puck according to claim 1, wherein the passing unit has accelerator rollers (42), and the accelerator rollers (42) have a rotation speed that can be adjusted by the user by way of frequency converters.

3. The device for competitive play with hockey stick and hockey puck according to claim 2, wherein two inclined collector surfaces (13) extend towards a conveying channel (14), whereby the conveying channel (14) has perpendicular walls and is so narrow that two flatly oriented pucks (1) cannot lie side-by-side.

4. The device for competitive play with hockey stick and hockey puck according to claim 3, wherein a circulating conveyor runs on the base of the conveying channel (14) in order to initially transport the shot and unsorted pucks (1) in this conveying channel (14) to one side.

5. The device for competitive play with hockey stick and hockey puck according to claim 4, wherein the conveyor apparatus consists of a pair of conveyor belts (6) below the vertical walls of the conveying channel (14) and several drivers (7) connecting the conveying belts (6) at a distance corresponding to the width of the conveying channel (14).

6. The device for competitive play with hockey stick and hockey puck according to claim 5, wherein the driver (7) has a rounded recess (26) in conveying direction and with about the curvature of the circumference of a puck (1), with which a puck (1) lying flat is centred in the conveying channel (14), that the driver is only high enough so that it captures only a puck (1) lying flat, that it includes a bevel (27) onto which a lift off tongue (18) can slide, and that it has a cut-out (25) in an upper surface into which the lift off tongue can engage.

7. The device for competitive play with hockey stick and hockey puck according to claim 6, wherein the path of the conveyor at the end of the horizontal conveyor portion (3) is redirected into an upwardly inclined conveyor portion (4) of preferably 45 degrees slope, so that pucks (1) standing upright in a first sorting step roll back onto the horizontal conveyor portion (3) for sorting.

8. The device for competitive play with hockey stick and hockey puck according to claim 7, wherein the inclined conveyor portion (4) merges into a vertical conveyor portion (5) so that in a second sorting step only pucks (1) guided exactly perpendicularly in front of a driver (7) are conveyed, while uncleanly positioned pucks (1) fall back.

9. The device for competitive play with hockey stick and hockey puck according to claim 8, wherein a knock off member (9) is provided at each side edge of the vertical conveyor portion (5) at a height of about 15 cm above the inclined conveyor portion (4) and at a horizontal spacing which is slightly larger than the diameter of a puck (1), so that in a third sorting step only pucks (1) exactly centred in the recess (26) of the driver (7) remain on the vertical conveyor portion (5), while not centrally lying pucks (1) are knocked off and fall back onto the horizontal conveyor portion (3).

10. The device for competitive play with hockey stick and hockey puck according to claim 9, wherein the conveying channel (14) in the horizontal and the inclined portions widens in conveying direction so that disadvantageously positioned pucks (1) cannot jam.

11. The device for competitive play with hockey stick and hockey puck according to claim 10, wherein between an upper end of the vertical conveyor portion (5) and an upper end of the puck magazine (30) a connecting ramp is provided which in direction of the vertical conveyor portion (5) has a lift-off tongue (18) which respectively engages the cut-out (25) in the top surface of the drivers (7) so that it reaches under and takes over a puck (1) lifted up at the vertex of the vertical conveyor portion (5) and guides the puck (1) onto a ramp downwardly inclined towards the puck magazine (30) where the puck (1) by gravity enters the helical ramp (33) of the puck magazine (30).

12. The device for competitive play with hockey stick and hockey puck according to claim 1, further including a computer controlled puck dispenser (35) located above the level of a game platform (10) releases pucks (1) which are advanced from the magazine by gravity.

13. The device for competitive play with hockey stick and hockey puck according to claim 12, wherein the computer controlled puck dispenser (35) consists essentially of a rotating disk (36) at the periphery of which are located separating rollers (37) which respectively protrude into a puck channel (34) extending past, so that the first separating roller (37) blocks the next closest, advancing puck (1) and releases that puck (1) only after a partial rotation of the rotating disk (36), whereby the second separating roller (37) just extends into the gap between the first and a following puck (1) and again blocks the following puck (1) until its release.

14. The device for competitive play with hockey stick and hockey puck according to claim 13, wherein the passing unit (46) is fed by way of the downwardly inclined puck channel (34) and from the puck magazine (30) and the higher positioned computer controlled puck dispenser (35), so that the released puck (1) enters without further technical cost at a preliminary speed into the passing unit (46) where it is additionally accelerated.

15. The device for competitive play with hockey stick and hockey puck according to claim 12, wherein a control console (51) with control keys (52) resting on the platform (10) is preferably provided, whereby the control keys (52) can be operated with the hockey stick so that the player (40) can carry out all dialogues with the computer without having to lay down the stick and remove the gloves.

16. The device for competitive play with hockey stick and hockey puck according to claim 15, wherein the control console (51) is movable on the game platform (10) in a direction transverse to the shot path so that it can be moved for right-handers and lefthanders alike to the side respectively opposite to and at the desired spacing from the player position.

17. The device for competitive play with hockey stick and hockey puck according to claim 1, wherein target surfaces on a target mat (15) are hierarchically divided into partial target surfaces A (22), partial target surfaces B (23) and partial target surfaces C (24).

18. The device for competitive play with hockey stick and hockey puck according to claim 17, wherein the capturing of a hit target surface is carried out by way of a camera (50) connected to the parallel port of the computer (60), whereby the image captured at the calculated moment is compared in the computer (60) with an image without puck (1) according to brightness and the position of the hit determined therefrom.

19. The device for competitive play with hockey stick and hockey puck according to claim 1, wherein the calculation of the point value (76) is based on the factors bit category (71), passing interval (72), passing speed (73), reaction time (74) and trajectory time (75).

20. The device for competitive play with hockey stick and hockey puck according to claim 19, wherein the point value for a shot is graphically illustrated on a monitor (65) in that the height of a bar (66) corresponds to the number of points and the colour of the bar (66) corresponds to the target category hit.

21. The device for competitive play with hockey stick and hockey puck according to claim 19, wherein the calculation of a series result (77) achieved on such a Device is carried out as the average shot point values (76) out of a selected number of shots, preferably 16 shots.

22. The device for competitive play with hockey stick and hockey puck according to claim 19, wherein the calculation of a daily result (78) achieved on such a Device is based on the average of at least two, preferably three best series results (77).

23. The device for competitive play with hockey stick and hockey puck according to claim 19, wherein the calculation of an annual result (79) achieved on such a Device is based on the average of at least two, preferably three best daily results (78).

24. The device for competitive play with hockey stick and hockey puck according to claim 19, wherein with the use of the international data network a worldwide valid ranking list position (80) is derived from the respective annual result (79) and the ranking list (81) is continuously updated, whereby the data structure is designed such that statistics corresponding to different inquiry criteria, selected from the group of inquiry criteria such as, age group, players of a team, players within a city, a country, can be output to anyone at any time and at any location.

* * * * *